US008348084B2

(12) United States Patent
Dahlquist et al.

(10) Patent No.: US 8,348,084 B2
(45) Date of Patent: Jan. 8, 2013

(54) CONTAINER HAVING SURROUNDING HANDLE AND GIMBAL

(75) Inventors: Kevin James Dahlquist, Charlotte, NC (US); Daniel Lee Bizzell, Davidson, NC (US); Ian D. Kovacevich, Charlotte, NC (US)

(73) Assignee: Edison Nation, LLC, Charlotte, NC (US)

( * ) Notice: Subject to any disclaimer, the term of this patent is extended or adjusted under 35 U.S.C. 154(b) by 1160 days.

(21) Appl. No.: 11/838,859

(22) Filed: Aug. 14, 2007

(65) Prior Publication Data

US 2008/0035644 A1 Feb. 14, 2008

Related U.S. Application Data

(60) Provisional application No. 60/822,367, filed on Aug. 14, 2006.

(51) Int. Cl.
*A47G 19/02* (2006.01)
*B65D 8/06* (2006.01)
*B65D 25/28* (2006.01)

(52) U.S. Cl. ..... 220/574; 220/23.87; 220/603; 220/629; 220/758

(58) Field of Classification Search ..... 220/780, 220/501, 560.03, 380, 23.87, 23.89, 574, 220/603, 758, 633
See application file for complete search history.

(56) References Cited

U.S. PATENT DOCUMENTS 705,404 A * 7/1902 Hopkins et al. ..... 220/569
1,507,370 A 9/1924 Freeble
1,509,734 A 9/1924 Langley
1,832,585 A 11/1931 Sample
2,492,152 A * 12/1949 Hollowell ..... 47/80
2,649,809 A * 8/1953 O'Neil ..... 74/5.2

(Continued)

FOREIGN PATENT DOCUMENTS

GB 2414652 A * 12/2005

(Continued)

OTHER PUBLICATIONS

"International Search Report" and "Written Opinion of the International Search Authority" (Korean Intellectual Property Office) in Bouncing Brain Productions Subsidiary 9, LLC et al. International Patent Application Serial No. PCT/US2006/031970, dated May 11, 2007, 6 pages.

(Continued)

*Primary Examiner* — Mickey Yu
*Assistant Examiner* — Niki Eloshway
(74) *Attorney, Agent, or Firm* — Tillman Wright, PLLC; Chad D. Tillman; James D. Wright

(57) ABSTRACT

A container includes a first bowl suspended by a dual-axis gimbal within—and out of contact with—a second bowl. The first bowl includes a first opening and the second bowl includes a second opening. The first opening overlies the second opening to permit access to an interior storage space of the first bowl from an exterior of the container when the first and second bowls are in respective upright orientations. The first bowl may be rotated 180 degrees in every rotational direction relative to the second bowl. A lid is removably attachable to the second bowl and that inhibits rotational movement of the first bowl. A handle circumferentially extends entirely around the second bowl and defines an opening for a finger or thumb for gripping and holding of the container when the lid is attached.

15 Claims, 8 Drawing Sheets

U.S. PATENT DOCUMENTS

| | | | | | |
|---|---|---|---|---|---|
| D174,182 | S | | 3/1955 | Kallenberg | |
| 3,473,234 | A | | 10/1969 | Kjellstrom et al. | |
| 3,628,690 | A | * | 12/1971 | Sherman | 220/721 |
| 3,949,483 | A | * | 4/1976 | White | 33/364 |
| 4,096,966 | A | | 6/1978 | Korshak | |
| 4,189,066 | A | | 2/1980 | Berghahn | |
| 4,303,172 | A | * | 12/1981 | Bosland | 220/252 |
| 4,453,317 | A | | 6/1984 | Rahn | |
| 4,714,174 | A | | 12/1987 | Williams | |
| 4,798,363 | A | * | 1/1989 | Cortesi | 248/97 |
| 4,908,066 | A | | 3/1990 | Taylor et al. | |
| 5,129,610 | A | | 7/1992 | Campbell | |
| 5,287,969 | A | * | 2/1994 | Kehr | 206/583 |
| 5,366,103 | A | | 11/1994 | Abernathy et al. | |
| D353,080 | S | | 12/1994 | Cantereels et al. | |
| 5,540,341 | A | | 7/1996 | Holley et al. | |
| D390,752 | S | | 2/1998 | DeCoster | |
| 5,724,914 | A | | 3/1998 | Nemeth | |
| 5,758,797 | A | | 6/1998 | Martindale | |
| 5,944,417 | A | | 8/1999 | Shiotani | |
| 5,957,038 | A | | 9/1999 | Shimazaki | |
| 5,967,362 | A | * | 10/1999 | Corbin | 220/758 |
| 5,975,016 | A | | 11/1999 | Wesenhagen | |
| 6,032,824 | A | | 3/2000 | Barrow | |
| D425,378 | S | | 5/2000 | Gilbertson | |
| 6,176,384 | B1 | | 1/2001 | Voloshin | |
| 6,253,918 | B1 | * | 7/2001 | Greiner | 206/457 |
| 6,405,638 | B1 | | 6/2002 | Chen | |
| D468,168 | S | | 1/2003 | Gruenberg | |
| 6,637,614 | B2 | | 10/2003 | Bergkvist | |
| 6,656,514 | B1 | | 12/2003 | Tubbs | |
| 2,414,697 | A1 | | 8/2006 | Pettersson | |
| D539,093 | S | | 3/2007 | Robinson | |
| D543,796 | S | | 6/2007 | Lion | |
| 7,306,112 | B2 | | 12/2007 | Shepard | |
| D572,978 | S | | 7/2008 | Bizzell | |
| 7,451,890 | B2 | * | 11/2008 | Ivey | 220/603 |
| 7,726,509 | B2 | | 6/2010 | Shepard | |
| 2004/0123746 | A1 | * | 7/2004 | Patsalos | 99/494 |
| 2005/0242100 | A1 | | 11/2005 | Shepard | |
| 2006/0016817 | A1 | | 1/2006 | Sheppard, Jr. et al. | |
| 2006/0070944 | A1 | | 4/2006 | Ahn et al. | |
| 2007/0267411 | A1 | | 11/2007 | Shepard | |
| 2007/0267421 | A1 | | 11/2007 | Shepard | |
| 2007/0272695 | A1 | | 11/2007 | Shepard | |
| 2008/0099488 | A1 | | 5/2008 | Dahlquist et al. | |

FOREIGN PATENT DOCUMENTS

| | | | |
|---|---|---|---|
| WO | 2008020844 | A1 | 2/2008 |
| WO | 2012008942 | A1 | 1/2012 |
| ZA | 200804526 | | 4/2009 |

OTHER PUBLICATIONS

Information Disclosure Statement (IDS) Letter Regarding Common Patent Application(s), submitted by Applicant on Jan. 30, 2009.

Informmation Disclosure Statement (IDS) Letter Regarding Common Patent Application(s), dated Nov. 3, 2009.

Information Disclosure Statement (IDS) Letter Regarding Common Patent Application(s), dated Jul. 20, 2012.

"International Search Report" and "Written Opinion of the International Search Authority" (Korean Intellectual Property Office) in Edison Nation, LLC et al. International Patent Application Serial No. PCT/US2010/041636, dated Apr. 28, 2011, 6 pages.

* cited by examiner

CONTAINER HAVING SURROUNDING HANDLE AND GIMBAL

I. CROSS REFERENCE TO RELATED APPLICATIONS

The present application is a U.S. nonprovisional patent application of, and claims priority under 35 U.S.C. §119(e) to, U.S. provisional patent application Ser. No. 60/822,367, filed Aug. 14, 2006, which provisional patent application is incorporated by reference herein.

II. COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

III. BACKGROUND OF THE INVENTION

The present invention generally relates to a container and, more particularly, to a "spill-proof" container.

Spill-proof containers marketed primarily for use by children are generally known. Such containers are typically designed for use with liquids such as milk and juice. Examples include U.S. Pat. No. 1,509,734 to Langley and U.S. Pat. No. 2,414,697 to Pettersson. The Langley patent discloses a drinking cup having an outer and an inner cup body, wherein the inner cup body is much more shallow than the outer cup body and fits in snug, sliding relation within the outer cup body. The inner cup body has holes in a peripheral wall thereof near a base thereof. When the drinking cup is tipped, liquid held in the outer cup body is able to flow into the inner cup body through one of the holes, wherein the liquid is accessible to a child using the drinking cup.

The Pettersson patent discloses a drinking cup having a generally cylindrical body and a threaded, removable lid having a central depending cavity that terminates at a point above a bottom of the cup and an arcuate opening adjacent a periphery thereof. Liquid may be poured into the drinking cup through the central depending cavity. A user may access the liquid in the drinking cup through the opening in the lid.

Spill-proof containers are also needed for solid snack-type food items such as crackers, cereal and the like. Containers for such snack-type food items are generally known. Examples include U.S. Pat. No. 4,714,174 to Williams and U.S. Pat. No. 6,656,514 to Tubbs. The Williams patent discloses a container having a first lid that covers a substantial portion of an interior of the container and that includes a tubular member that extends through downwardly into the interior of the container without reaching a bottom of the container and extends slightly upward above the first lid. The tubular member serves as a conduit allowing a user to access the interior of the container when the first lid is fitted onto the container. A second lid fits over the tubular member. A user may remove the second lid and access foodstuff located in the interior of the container via the tubular member.

The Tubbs patent discloses a container having a spill-proof lid comprising generally triangular, flexible, resilient flaps that extend in a generally radial direction inwardly from a rim of the lid. The flaps are configured to meet or overlap one another. When a user presses a hand through the flaps, the flaps bend toward an interior of the container to allow a user's hand to pass there through but return to their original position when the user's hand is removed there from. The lid further comprises a channel having openings there through adjacent the rim. Food crumbs dropped on the lid thereby may be returned to the interior of the container through the openings of the channel.

U.S. Patent Application Publication No. US 2005/0242100 A1 to Shepard, which is incorporated herein by reference in its entirety, discloses a spill-proof container for snack-type food items. The spill-proof container includes a bowl and a support member that receives and supports the bowl. The bowls includes a counterweight attached thereto that acts to self-right the bowl regardless of the orientation of the support member. The container allows a user complete access to an interior of the bowl, i.e., a lid does not completely or partially obstruct the user's access or visibility to the interior of the bowl. Moreover, the container of Shepard does not utilize a lid to enhance the spill-proof characteristic of the container.

While the container of Shepard is fit for its intended purpose, the container does have a drawback. The motion of the container is not fluid because of a frictional, sliding contact between the walls of the bowl and the support member. At least one aspect of the present invention overcomes this drawback of the Shepard container by eliminating the frictional, sliding contact between the walls of a bowl and a support member of a spill-proof container assembly, thereby providing smooth, fluid movement.

IV. SUMMARY OF THE INVENTION

The present invention includes many aspects and features.

In an aspect of the invention, a container assembly comprises a first member defining an interior containment space and having an access opening thereto, a second member dimensioned to encompass the first member, and a third member that interconnects the first member and the second member. The first and third members are connected along a first axis such that the first member is rotatable about the first axis relative to the third member. The second and third members are connected along a second axis such that the third member is rotatable about the second axis relative to the second member. The first axis is generally orthogonal to the second axis.

In a feature of this aspect, the second member is dimensioned to surround or encompass the first member without obstructing the access opening of the first member when the first and second members are disposed in a particular orientation relative to one another. In another feature of this aspect, the first member is weighted for biasing of the first member to a particular gravitational origination and, preferably, the first member includes a weight for maintaining the first member in a generally fixed orientation relative to the force of gravity when an orientation of the second member is changed. In an additional feature, the container assembly further comprises articles of food contained within the interior containment space of the first member. In yet another feature, the first member comprises a bowl. In another additional feature, the second member comprises a bowl-shaped member.

In another aspect of the invention, a container assembly comprises a bowl; a support member at least encompassing the bowl; and a gimbal disposed between and interconnecting the support member and the bowl. The gimbal is configured to suspend the bowl in an upright orientation regardless of the orientation of the support member.

In a feature of this aspect, the support member comprises a base and coupling secured together in threaded engagement. In another feature of this aspect, the coupling defines opposed recesses and pins of the gimbal that are concentric to a first axis extend within the opposed recesses of the coupling. In accordance with this feature, a rim of the base bridges each opposed recess of the coupling to retain the pins of the gimbal within the coupling. It is preferred that the gimbal defines opposed openings concentric to a second axis. The bowl includes pins extending along the second axis within the opposed openings of the gimbal. It is further preferred that the first axis and the second axis are generally orthogonally disposed relative to one another.

In an additional feature, the assembly further comprises a weight attached to a bottom of the bowl. In another additional feature, the support member comprises a base having a plurality of openings extending completely there through from an interior surface to an exterior surface. In a further feature, the support member comprises a plurality of feet extending from an exterior surface thereof for support of the support member on a surface. In yet another feature, the container assembly may be disassembled and reassembled by a user.

In still yet another feature, the container assembly is fabricated from dishwasher safe materials. In an additional feature, the assembly further comprises a lid that is removably attachable to the support member. In another additional feature, the support member comprises a bowl-shaped base and a coupling for attaching the gimbal to the base, and further comprises a lid that is removably attached to the coupling for covering of the bowl. In a further feature, the lid inhibits movement of the bowl relative to the support member when the lid is attached to the coupling.

In another aspect of the invention, a container assembly comprises a first member defining an interior containment chamber and an access opening to the chamber; a second member dimensioned to substantially, but not completely, encompass the first member; and means for suspending the first member within the second member in a particular gravitational orientation independent of changes in gravitational orientation of the second member.

Yet additional aspects and features are disclosed below in the detailed description of preferred embodiments and the drawings.

In addition to the aforementioned aspects and features of the present invention, it should be noted that the present invention further includes the various possible combinations of such aspects and features.

V. BRIEF DESCRIPTION OF THE DRAWINGS

Further aspects, features, embodiments, and advantages of the present invention will become apparent from the following detailed description with reference to the drawings, wherein.

VI. DETAILED DESCRIPTION

Figure 1:
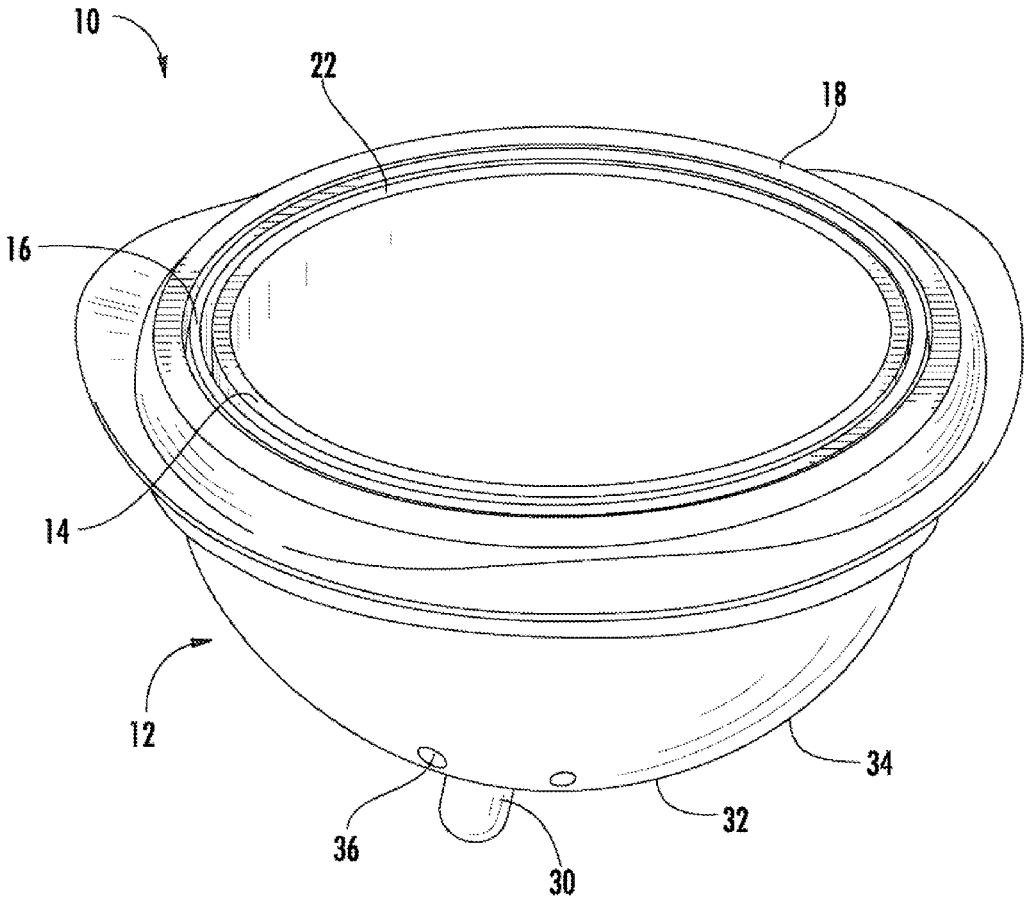
FIG. 1 is a perspective view of a container assembly (without a lid) in accordance with a preferred embodiment of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Additionally, as used herein, a "spill-proof" container or container assembly is generally intended to mean a container in which the contents will be substantially retained when the container is tilted, knocked over or otherwise rolled onto a side thereof or turned upside down. In contrast, a "spill-proof" container is not necessarily a container that retains its contents when in free fall or when dropped.

Finally, as used herein, an "upright orientation" of a bowl is intended to refer to a disposition of a bowl wherein a plane containing a rim of an opening of the bowl is generally oriented orthogonal to the direction of the force of gravity.

Referring now to the drawings, one or more preferred embodiments of the present invention are next described. The following description of preferred embodiment(s) is merely exemplary in nature and is in no way intended to limit the invention, its application, or uses.

Figure 2:
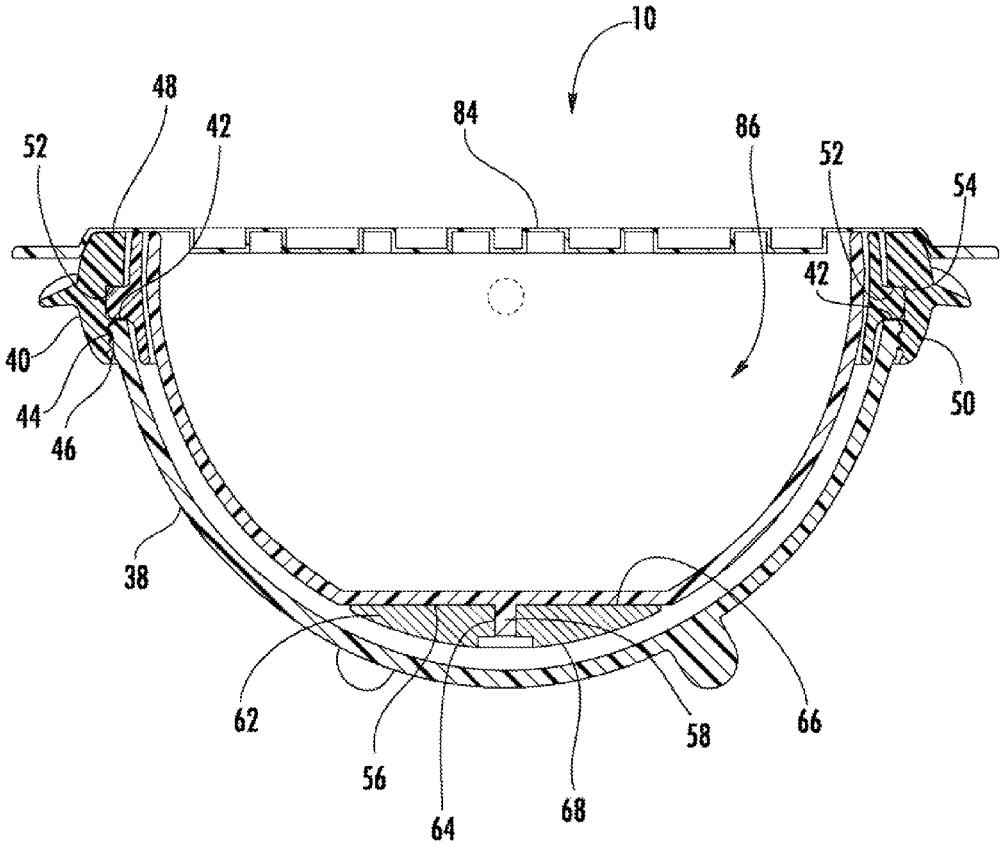
FIG. 2 is a bisectional view of the container assembly of FIG. 1 that includes a lid.
Figure 3:
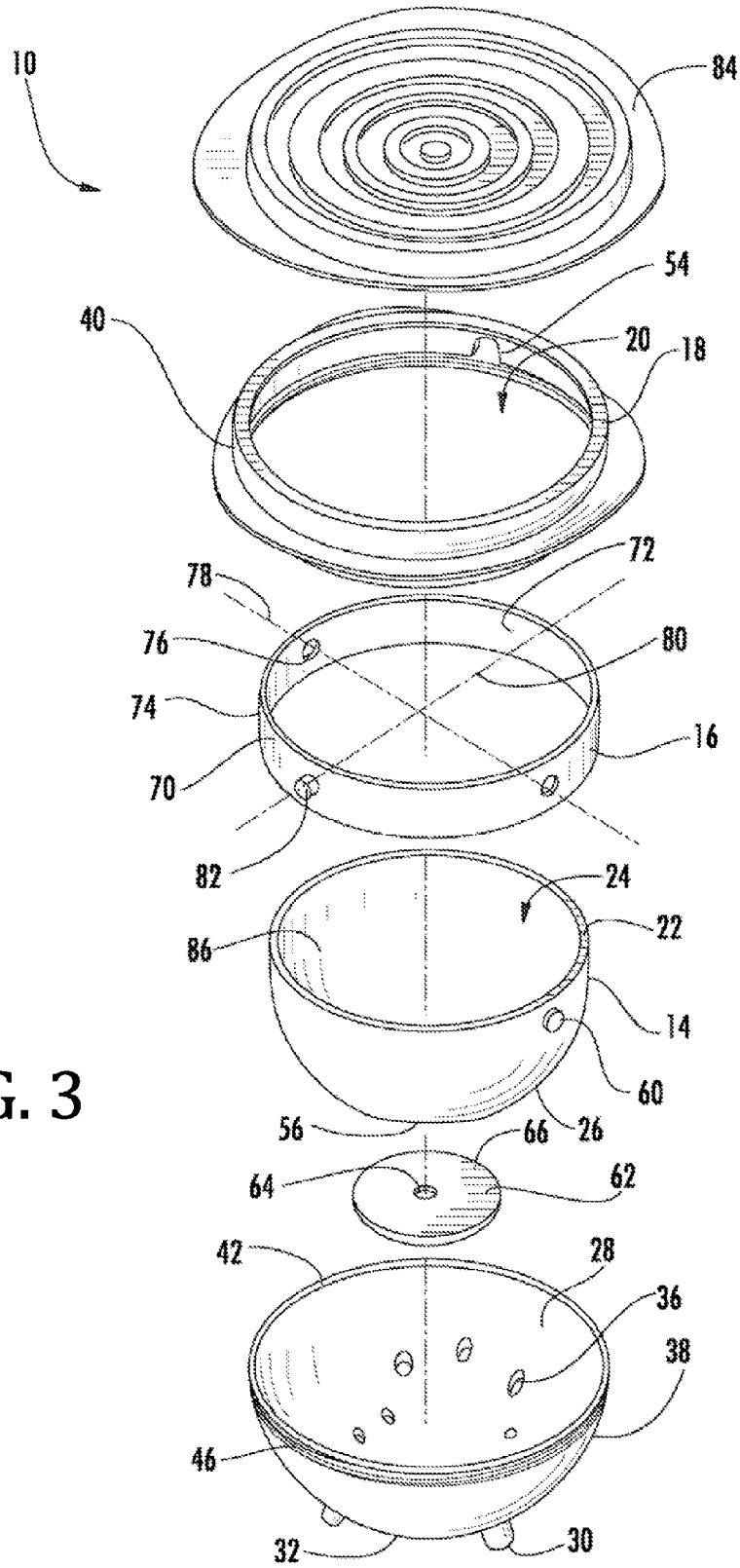
FIG. 3 is an exploded perspective view of the container assembly of FIG. 2.

FIGS. 1-3 provide multiple views of a spill-proof container assembly 10 in accordance with a first preferred embodiment of the present invention. In this regard, FIG. 1 is a perspective view of the container assembly 10; FIG. 2 is a bisectional view of the container assembly 10 of FIG. 1, including a lid 84; and FIG. 3 is an exploded perspective view of the container assembly 10 of FIG. 2. The container assembly 10 includes a support member 12, a bowl 14, and a gimbal 16 disposed between and operatively interconnecting the support member 12 and the bowl 14. With reference particularly to FIGS. 1-3, each of these three components are now described in detail below.

The Support Member

The support member 12 itself generally includes two components comprising a bowl-shaped base 38 and an annular coupling 40. The base 38 defines a rim 42 surrounding access to an interior space in which the gimbal 16 and bowl 14 are at least partially disposed. The base 38 as illustrated is substantially bowl-shaped; however, the base 38 alternatively could be a simple framework or other structure that at least partially encompasses the exterior of bowl 14 and serves to support the bowl 14 via the gimbal 16.

The coupling 40 removably attaches to the top of the base 38 generally adjacent the rim 42 of the base 38. More particularly, an exterior surface 46 of the base 38 and an interior surface 44 of the coupling 40 include respective mating threads such that a detachable, threaded connection is enabled between the base 38 and the coupling 40.

The coupling 40 includes an upper section 48 and a lower section 50. The upper section 48 has a slightly smaller inner diameter than that of the lower section 50, and an annular ledge 52 extends between the upper section 48 and the lower section 50. The ledge 52 defines a pair of generally arch-shaped recesses 54, discussed in further detail below. As described previously, the interior surface 44 of the lower section 50 includes the threads for connection with the base 38. When the coupling 40 is tightly screwed onto the base 38, the ledge 52 of the coupling 40 generally comes into abutting relation with, and is supported by, the rim 42 of the base 38. The upper section 48 further defines a rim 18 that surrounds an opening 20 through which the gimbal 16 and the bowl 14 are generally free to move, as described below, when the coupling 40 is connected to the base 38.

The two recesses 54 formed in the upper section 48 are arranged in opposite facing relation to one another. When the coupling 40 is tightly screwed onto the base 38 and the ledge 52 of the coupling 40 generally abuts the rim 42 of the base 38, the rim 42 bridges the recesses 54 defined by the ledge 52 and secures a pair of pins 82 of the gimbal 16 to the base 38, as discussed in greater detail below. The pair of recesses 54 of the coupling 40 thereby facilitate connection of the gimbal 16 to the support member 12.

On the bottom of the support member 12 are disposed a plurality of feet 30, which aid in maintaining the support member 12 in a stable, upright orientation when it is placed on a surface, such as a tabletop. The plurality of feet 30 include three rounded feet that are evenly spaced from one another and that extend from an exterior surface 34 of the support member. Although three rounded feet 30 are used in the illustrated embodiment, it is contemplated that any number of feet may be used, as desired, so long as the support member 12 is maintained in a stable, upright orientation when placed, for example, on a tabletop.

A plurality of openings 36 extend through the bottom 32 of the base 38. The openings 36 provide passages by which may be removed food debris that has fallen between the support member 12 and the bowl 14.

The Gimbal

The gimbal 16 comprises a ring-shaped member having a peripheral wall 70. The peripheral wall 70 has an interior surface 72 and an exterior surface 74. The gimbal 16 also includes a pair of gimbal openings 76 that extend through the peripheral wall 70 thereof and are disposed in opposite facing relation with one another and generally lie along a first gimbal axis 78. The gimbal 16 further includes a pair of pins 82 that protrude outwardly in a radial direction from the exterior surface 74 of the peripheral wall 70. The pair of pins 82 generally are coaxially disposed relative to one another and are concentric with a second gimbal axis 80, which is generally orthogonal to the first gimbal axis 78, i.e., the first and second gimbal axes 78,80 are substantially at a 90 degree angle with respect to each other.

The Bowl

The bowl 14 is semi-spherically shaped and includes a rim 22 that surrounds an opening or "mouth" 24 of the bowl 14. The bowl 14 is received within the interior space of the base 38 of the support member 12, with an exterior surface 26 of the bowl 14 extending preferably substantially adjacent-but out of contact with-an interior surface 28 of the base 38 when the bowl 14 is disposed therein. The bowl 14 and the support member 12 are configured such that the rim 18 of the coupling 40 of the support member 12 may be aligned with the rim 22 of the bowl 14 when the bowl 14 is disposed within the base 38. As such, the opening 20 of the support member 12 and the mouth 24 of the bowl 14 may be aligned and disposed in concentric relation to each other.

The bowl 14 preferably includes a substantially planar bottom 56. Furthermore, a cylindrical connection member 58 extends from the exterior surface 26 of a center of the bottom 56 of the bowl 14. A counterweight 62 that is generally disk-like in shape is detachably connected to the bottom 56 of the bowl 14. The counterweight 62 includes an aperture 64 extending through a center thereof, and the cylindrical connection member 58 of the bowl 14 extends through the aperture 64 for attachment of the counterweight 62 to the bottom of the bowl 14. One side 66 of the counterweight is substantially planar and an opposite side 68 is curved. The substantially planar side 66 of the counterweight 62 abuts the planar bottom 56 of the bowl 14 when the counterweight 62 is connected to the bowl 14. The curvature of the other side 68 of the counterweight 62 matches that of the bowl 14 such that when the counterweight 62 is connected to the bowl 14, the counterweight 62 continues the spherical curvature of the exterior surface 26 of the bowl 14 without interruption. By use of the counterweight 62, the bowl 14 is weighted and biased toward a particular gravitational orientation regardless of the gravitational orientation of the support member 12, as further described below.

The bowl 14 includes a pair of pins 60, disposed proximate the rim 22 of the bowl 14, that protrude radially a small distance outwardly from the exterior surface 26 of the bowl 14. The pair of pins 60 generally are coaxially disposed relative to one another.

When the container assembly 10 is assembled, the gimbal 16 is disposed between and interconnects the bowl 14 and the support member 12. Specifically, the pair of pins 60 of the bowl 14 are positioned to extended into the pair of openings 76 in the gimbal 16 such that the pins 60 are concentric with the first gimbal axis 78. This secures the bowl 14 to the gimbal 16. This connection also enables the bowl 14 to freely rotate about the first gimbal axis 78.

Similarly, the pair of pins 82 of the gimbal 16 are positioned to extend into the pair of recesses 54 of the coupling 40 and retained therein by the rim 42 bridging the recesses 54. This secures the gimbal 16, and indirectly the bowl 14, to the support member 12. This connection to the support member 12 also enables the gimbal 16, and thus the bowl 14, to freely rotate about the second gimbal axis 80.

Figure 4:
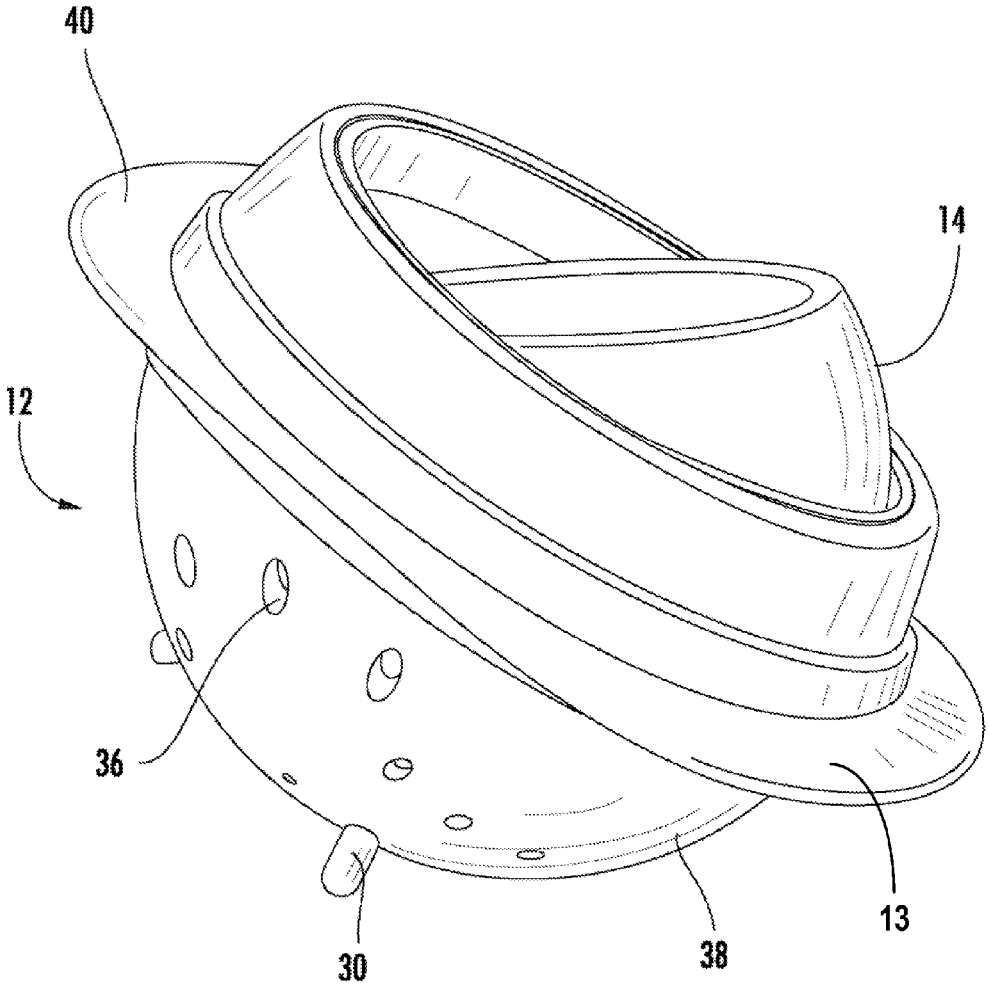
FIG. 4 is a perspective view of the container assembly of FIG. 1 in a tilted position.

Furthermore, the interior space of the base 38 is dimensioned such that the bowl 14 is not inhibited in its movement about either of the first or second gimbal axes 78,80 when the support member 12 and bowl 14 are interconnected by the gimbal 16. The gimbal 16 thereby suspends the bowl 14 within the base 38 of the support member 12 so that the bowl 14 may remain in an upright orientation regardless of the orientation of the support member 12. If the support member 12 is tilted (whether because it has been knocked over or because a user holding the container assembly 10 has tilted the support member 12), the bowl 14 nevertheless will remain in an upright orientation due to the force of gravity acting upon the counterweight 62 and the uninhibited movement of the bowl 14 about the first and second gimbal axes 78,80. For example, FIG. 4 illustrates a scenario in which the support member 12 is placed in a tilted disposition with the bowl 14 self-righting itself to remain in an upright orientation. In this illustrated example, the bowl 14 is shown rotated about the first gimbal axis 78.

As shown in FIGS. 2 and 3, the container assembly 10 also preferably includes a lid 84 that is generally planar and that fits onto the rim 18 for covering of the interior space of the base 38 when the coupling 40 is connected to the base 38. As is conventional, the lid includes an undercut feature (not shown) that catches on the rim 18 when it is placed thereon. The undercut feature secures the lid to the rim until it is removed by a user desiring to access the interior space of the bowl. If it is desired to retain the bowl 14 in fixed disposition relative to the base 38, the lid 84 may be placed onto the coupling 40. The lid 84 will prevent the bowl 14 from rotating about either of the gimbal axes 78,80.

Use of the Container Assembly

In use, the container assembly 10 is believed to provide a "spill-proof" container. In this respect, items that are placed within an interior 86 of the bowl 14 will not escape if the container assembly 10 is tilted, knocked over, or turned upside down. Accordingly, it will be appreciated that solid snack-type food items may be safely placed and retained within the bowl 14 of the container assembly 10. Ready access to the food items may then be had through the opening 20 and mouth 24. The container assembly 10 may be conveniently placed on a support surface such as the ground or a tabletop, or the container assembly 10 may be held in a user's hand. Furthermore, it is preferred that the components of the container assembly 10 be sized to accommodate a hand of a child. However, the container assembly 10 may be sized for adult use as well.

The container assembly 10 may be conveniently used during travel or other times when an adult and child are away from the home. The lid 84 of the container assembly 10 may be placed thereon to insure that food items do not fall out of the bowl in transit. The container assembly 10 may then be placed in a travel bag of some sort, for example, a diaper bag or purse, for use at a later time by the child or the adult. The adult simply removes the container assembly 10 from the bag or purse and removes the lid 84 to ready the container assembly 10 for use for snacking. Even with the lid 84 removed, the container assembly 10 is spill-proof. Such functionality allows the adults to be less concerned about their children spilling food and making a mess while at home and away from home.

Additionally, the container assembly 10 may be used for holding snack-type food items such as crackers, cereal and the like, and the overall appearance of the container assembly may resemble that of a toy spaceship.

In view of the foregoing, it will further will be appreciated that the container assembly 10 provides a spill-proof container for snack-type food items that allows a user complete access and visibility to an interior of the container. In this respect, a lid does not completely or partially obstruct a user's access or visibility to the interior of the container. Moreover, the container assembly 10 provides a spill-proof container that does not utilize a lid to enable the spill-proof characteristic of the container. Rather, the dual-axis gimbal 16 of the container assembly 10 enables the bowl 14 to be self-righting and, furthermore, enables smooth motion of the bowl 14 relative to the support member 12 when performing the spill-proof action.

In an alternative embodiment (not shown), the gimbal is semi-spherical and is dimensioned to at least partially surround the bowl 12. Similar to the base 38, the semi-spherical gimbal also includes openings that register with the openings 36 in the base 38 for escape of any food debris that may fall between the gimbal and the bowl 14. In yet other alternative embodiments, the gimbal and base each comprises a framework in which the area of the openings in the framework far exceeds the surface area of the framework itself.

Figure 5:
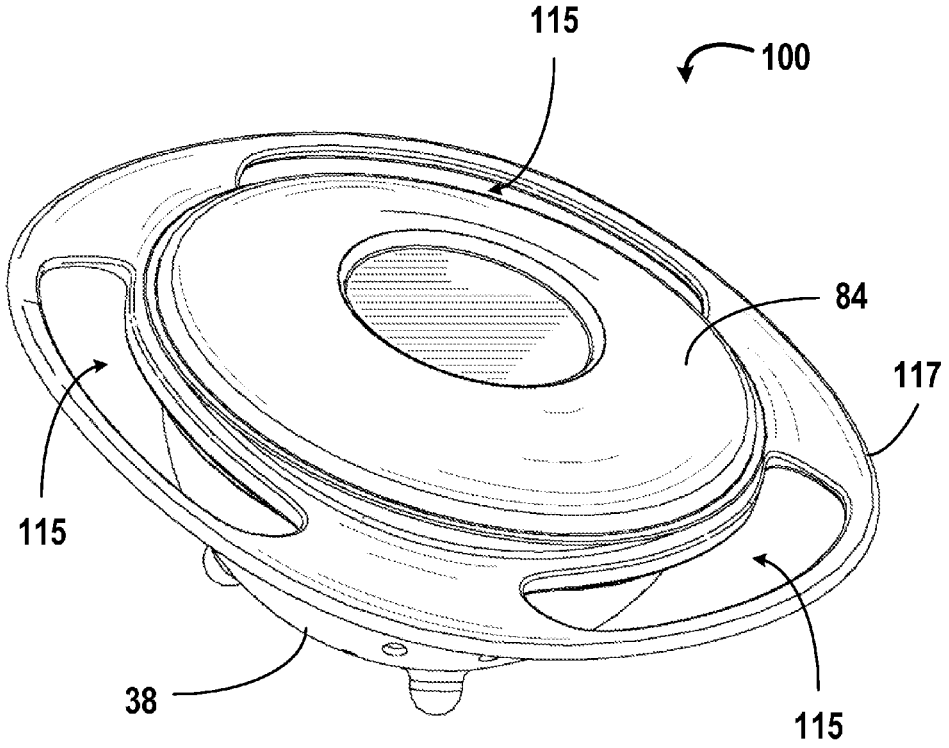
FIG. 5 is a perspective view of a container assembly in accordance with another preferred embodiment of the present invention.
Figure 6:
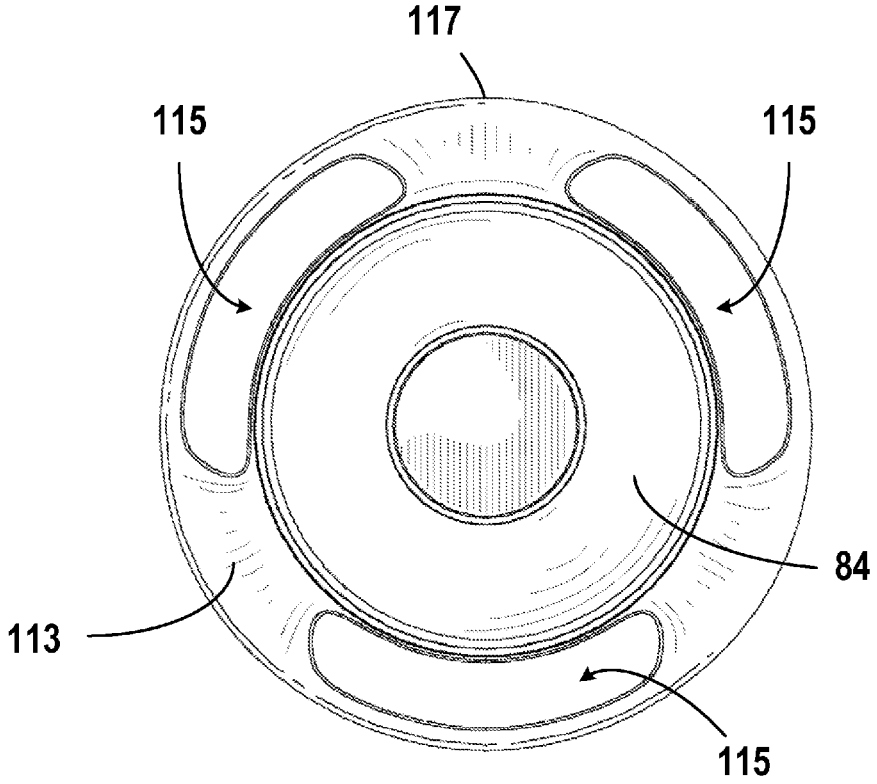
FIG. 6 is a top plan view of the container assembly of FIG. 5.
Figure 7:
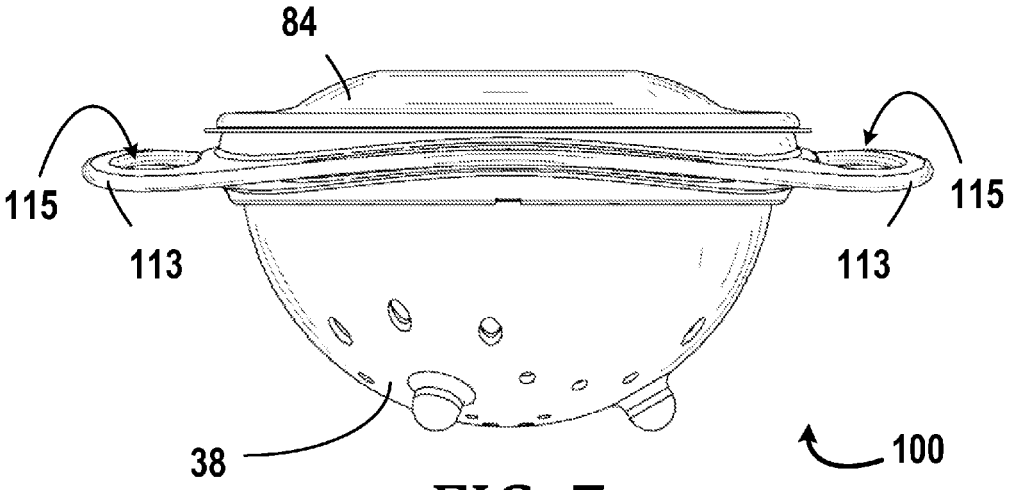
FIG. 7 is side elevational view of the container assembly of FIG. 5.
Figure 8:
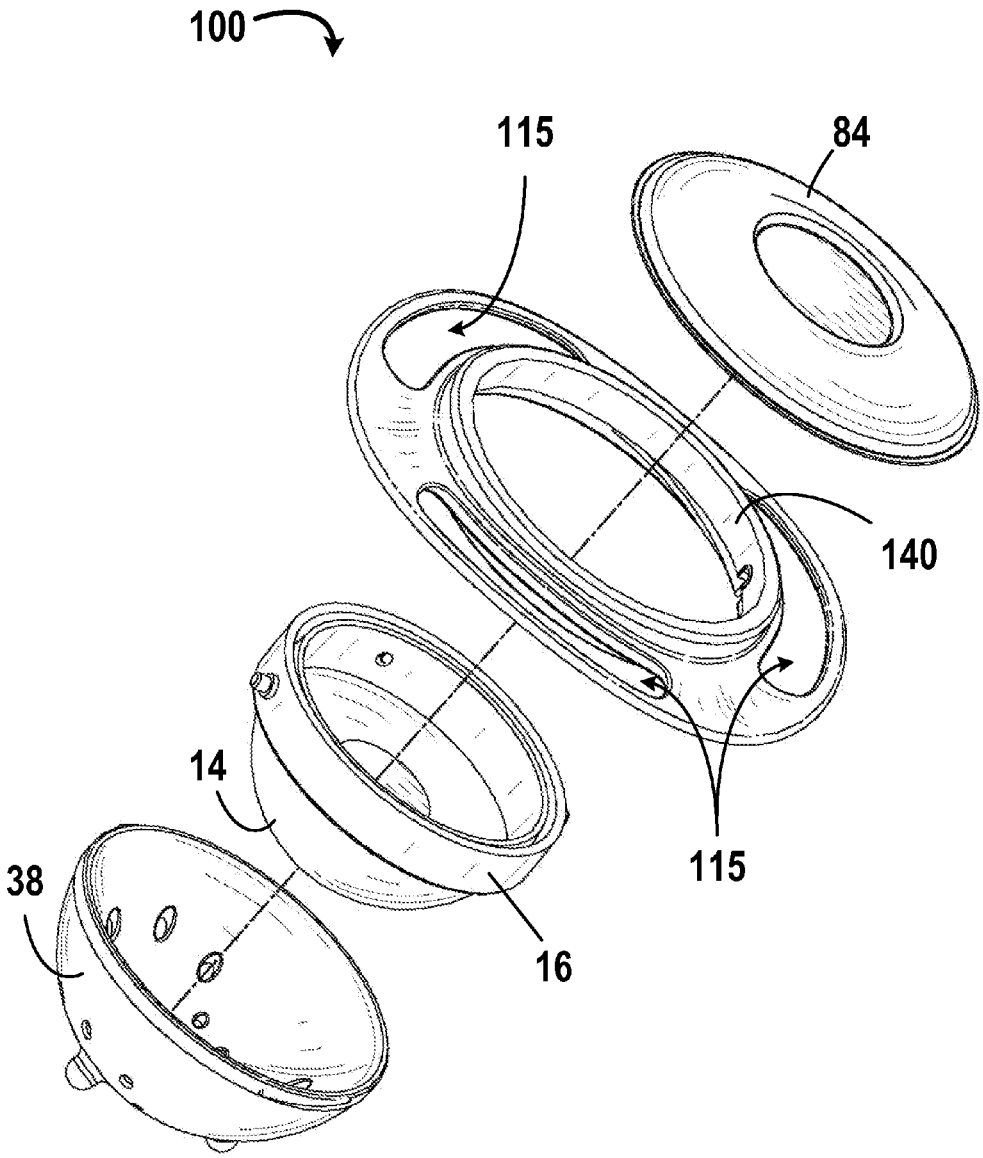
FIG. 8 is a partially exploded perspective view of the container assembly of FIG. 5.
Figure 9:
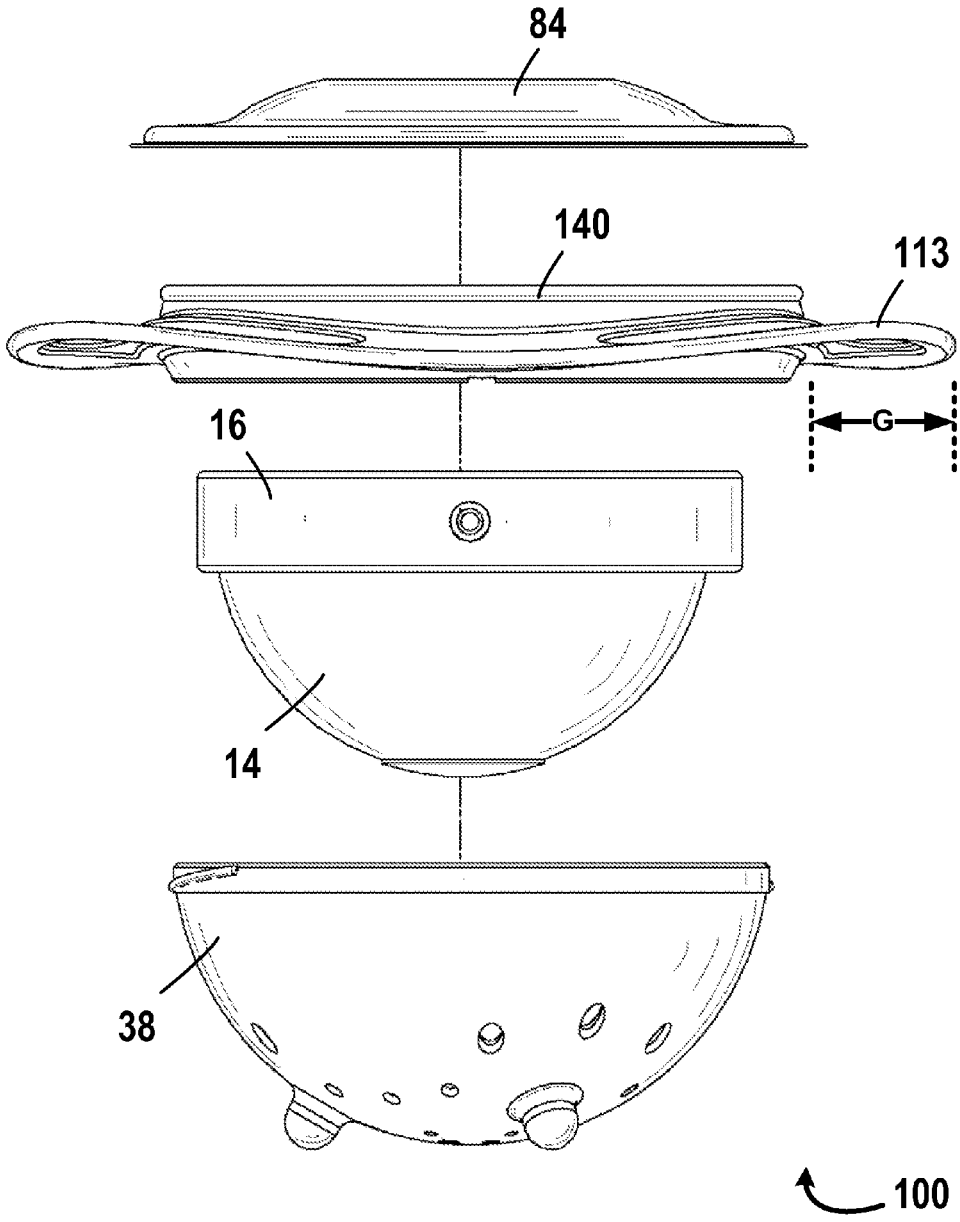
FIG. 9 is a partially exploded side plan view of the container assembly of FIG. 5.

A container assembly 100 in accordance with a second preferred embodiment is shown in FIGS. 5-9. In this regard, FIG. 5 is a perspective view of the container assembly 100; FIG. 6 is a top plan view of the container assembly 100; FIG. 7 is side elevational view of the container assembly 100; FIG. 8 is a partially exploded perspective view of the container assembly 100; and FIG. 9 is a partially exploded side plan view of the container assembly 100.

Container assembly 100 is substantially similar to container assembly 10 and, to the extent that components and features are the same, the description of such components and features set forth above with regard to container assembly 10 applies equally to container assembly 100. For example, like container assembly 10, container assembly 100 also includes a bowl shaped support member 38, a bowl 14, a gimbal 16, and a lid 84.

Among the differences, container assembly 100 includes a handle 113 that extends circumferentially completely about the upper portion of the bowl shaped base 38. Specifically, the handle 113 is integrally formed with coupling 140 and includes a wide girth "G" (shown in FIG. 9) that flares radially outwardly from the access opening defined by the base 38. Furthermore, the handle 113 defines three openings 115, each being dimensioned for receipt therethrough of one or more fingers of a child for griping of the handle 113 and holding of the container assembly 100.

Handle 113 provides a mechanism for gripping and holding of the container assembly 100 that is preferred over the handle 13 of the container assembly 10 (which handle 13 is perhaps best seen in FIG. 4). The handle 113 is advantageous because it has been found in product testing that the natural tendency of young children is to grip and hold the container assembly 10 at the rim 18 of the annular coupling 40. As will be appreciated, gripping and holding the container assembly 10 at the rim 18 of the annular coupling 40 can inhibit free rotational movement of the bowl 14 relative to the support member 12 which, in turn, can defeat the "no spill" benefits provided by the container assembly 10.

In contrast, it is believed that handle 113 is an improvement over handle 13 because it is believed that the natural tendency of young children will be to grip and hold the container assembly 100 at handle 113, with one or more fingers extending through one or more of the openings 115. As will be appreciated, gripping and holding the container assembly 100 at the handle 113 does NOT inhibit free rotational movement of the bowl 14 relative to the base 38, and, thus, does NOT defeat the "no spill" benefits provided by the container assembly 100.

Furthermore, due to the girth "G" of handle 113 (shown in FIG. 9), it is believed that it would be somewhat awkward-if not extremely difficult-for a baby or toddler to grip with fingers and thumb the container assembly 100 between the rim of the annular coupling 140 and the exterior circumferential periphery 117 of the handle 113. Thus, the girth of the handle 113 combined with the proximity of the handle 113 to the access opening in the base 38 is believed to further reduce the tendency of a young child to grip and hold the container assembly 100 so as to inhibit free rotational movement of the bowl 14 relative to the base 38.

In conclusion, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A container assembly, comprising:

(a) a bowl;

(b) a gimbal to which the bowl is mounted for rotational movement, relative thereto;

(c) a base at least partially encompassing the bowl; and (d) a coupling attached to the base and that secures the gimbal to the base for rotational movement relative to the base;

(e) wherein the bowl is suspended in an upright orientation relative to the base regardless of the orientation of the base;

(f) wherein the bowl is configured to rotate simultaneously about two axes; and (g) wherein the base and the coupling are attached together by threaded engagement.

2. The container assembly of claim 1, further comprising a handle having a wide girth that circumferentially extends entirely around an upper portion of the base.

3. The container assembly of claim 2, wherein the handle defines an opening for receipt therethrough of a finger or thumb of a hand for gripping and holding of the container assembly.

4. The container assembly claim 1, further comprising a handle that is integrally formed with the coupling.

5. The container assembly of claim 1, wherein the bowl includes a weight incorporated therein for biasing the bowl in a generally fixed orientation relative to the force of gravity when an orientation of the base changes.

6. The container assembly of claim 1, wherein the base includes a plurality of openings extending completely therethrough from an interior to an exterior thereof.

7. The container assembly of claim 1, wherein the base includes a plurality of feet extending from an exterior surface thereof for support of the container assembly on a surface.

8. A container assembly, comprising:

(a) a bowl;

(b) a gimbal to which the bowl is mounted for rotational movement, relative thereto;

(c) a base at least partially encompassing the bowl;

(d) a coupling attached to the base and that secures the gimbal to the base for rotational movement relative to the base; and (e) a lid that is removably attachable to the coupling and that inhibits rotational movement of the bowl relative to the base when the lid is attached to the coupling;

(f)wherein the bowl is suspended in an upright orientation relative to the base regardless of the orientation of the base; and (g) wherein the bowl is configured to rotate simultaneously about two axes.

9. The container assembly of claim 8, further comprising a handle that circumferentially extends entirely around an upper portion of the base and that defines an opening for receipt therethrough of a finger or thumb of a hand for gripping and holding of the container assembly when the lid is attached to the coupling.

10. The container assembly of claim 9, wherein the handle is integrally formed with the coupling.

11. The container assembly of claim 8, wherein the bowl includes a weight incorporated therein for biasing the bowl in a generally fixed orientation relative to the force of gravity when an orientation of the base changes.

12. The container assembly of claim 8, wherein the base includes a plurality of openings extending completely therethrough from an interior to an exterior thereof.

13. The container assembly of claim 8, wherein the base includes a plurality of feet extending from an exterior surface thereof for support of the container assembly on a surface.

14. A container, comprising:

(a) a first bowl suspended within, and out of contact with, a second bowl by a dual-axis gimbal, wherein:

(i) the first bowl includes a first opening and the second bowl includes a second opening;

(ii) the first opening overlies the second opening to permit access to an interior storage space of the first bowl from an exterior of the container when the first and second bowls are in respective upright orientations; and (iii) the first bowl may be simultaneously rotated relative to the second bowl about first and second gimbal axes; and (b) a lid that is removably attachable to the second bowl and that inhibits rotational movement of the first bowl relative to the second bowl when the lid is attached to the second bowl.

15. The container of claim 14, further comprising a handle that circumferentially extends entirely around an upper portion of the second bowl and that defines an opening for receipt therethrough of a finger or thumb of a hand for gripping and holding of the container when the lid is attached to the second bowl.

* * * * *